US009800006B1

(12) United States Patent
Kim

(10) Patent No.: US 9,800,006 B1
(45) Date of Patent: Oct. 24, 2017

(54) DOWNLOADER GENDER CASE

(71) Applicant: LSIS CO., LTD., Gyeonggi-do (KR)

(72) Inventor: Kyung-Min Kim, Gyeonggi-do (KR)

(73) Assignee: LSIS CO., LTD., Gyeonggi-Do (KR)

( * ) Notice: Subject to any disclaimer, the term of this patent is extended or adjusted under 35 U.S.C. 154(b) by 0 days.

(21) Appl. No.: 15/394,079

(22) Filed: Dec. 29, 2016

(30) Foreign Application Priority Data

Apr. 7, 2016 (KR) ..... 10-2016-0043051

(51) Int. Cl.
*H01R 27/02* (2006.01)

(52) U.S. Cl.
CPC ..... *H01R 27/02* (2013.01)

(58) Field of Classification Search
CPC . H01R 13/4538; H01R 13/447; H01R 13/631
USPC ..... 439/136–145
See application file for complete search history.

(56) References Cited

U.S. PATENT DOCUMENTS 6,075,706 A * 6/2000 Learmonth ..... G06K 19/077 235/441
6,132,223 A * 10/2000 Seeley ..... G06K 19/077 439/377
6,612,853 B2 * 9/2003 Wu ..... G06K 19/077 439/136
6,758,688 B2 * 7/2004 Chen ..... H01R 13/6395 439/135
7,303,411 B1 * 12/2007 Morganstern ..... H01R 13/447 439/131
7,364,445 B1 * 4/2008 Ni ..... H05K 5/0278 439/140
7,479,041 B1 * 1/2009 Chen ..... H01R 13/60 439/528
7,530,823 B1 * 5/2009 Thornton ..... H01Q 1/2275 439/131
7,686,629 B1 * 3/2010 Yu ..... H01R 13/447 439/136
7,740,492 B2 * 6/2010 Dei Rossi ..... H01R 13/60 439/131
8,194,408 B2 * 6/2012 Chou ..... H01R 13/4538 361/737

(Continued)

FOREIGN PATENT DOCUMENTS

KR 10-1053465 B1 8/2011
KR 20-2011-0012005 U 12/2011

(Continued)

*Primary Examiner* — Gary Paumen
(74) *Attorney, Agent, or Firm* — Nath, Goldberg & Meyer; Jerald L. Meyer

(57) ABSTRACT

A downloader gender case is disclosed. The download gender case according to the present invention comprises: a fixed cover for fixing a substrate, configured to surround a part of the substrate and the periphery of a header and formed with a first through hole through which the header is opened; a slide cover disposed on the outer side of the fixed cover, configured to surround the other part of the substrate and the periphery of a pin header and formed with a second through hole through which the pin header is opened; and an opening and closing portion coupled with the slide cover to open and close the second through hole, the slide cover being capable of sliding in a direction toward the header or the pin header.

7 Claims, 5 Drawing Sheets

(56) References Cited

U.S. PATENT DOCUMENTS

| | | | | |
|---|---|---|---|---|
| 2006/0258196 | A1* | 11/2006 | Chen | H01R 13/4538 439/141 |
| 2007/0103880 | A1* | 5/2007 | Feng | H01R 27/00 361/796 |
| 2007/0132732 | A1* | 6/2007 | Chen | G06F 3/03543 345/163 |
| 2008/0305650 | A1* | 12/2008 | Chen | H01R 13/2442 439/62 |
| 2012/0052704 | A1* | 3/2012 | Yen | H01R 13/4538 439/131 |
| 2012/0155721 | A1* | 6/2012 | Zhang | G06K 19/07 382/124 |
| 2012/0162876 | A1* | 6/2012 | Kim | H04M 1/0237 361/679.01 |
| 2013/0122727 | A1* | 5/2013 | Liao | H01R 13/4534 439/136 |

FOREIGN PATENT DOCUMENTS

| | | | |
|---|---|---|---|
| KR | 10-1315475 | B1 | 10/2013 |
| KR | 20-2016-0000882 | U | 3/2016 |

* cited by examiner

DOWNLOADER GENDER CASE

CROSS REFERENCE TO RELATED APPLICATION

This application claims the benefit of Korean Patent Application No. 10-2016-0043051, filed on Apr. 7, 2016, entitled "DOWNLOADER GENDER CASE", which is hereby incorporated by reference in its entirety into this application.

BACKGROUND

1. Technical Field

The present invention relates to a downloader gender case.

2. Description of the Related Art

In general, a downloader gender is an auxiliary device that is utilized in a downloader for downloading software to industrial electronics, which connects a software providing device such as a smart copier and the like and the industrial electronics so that the industrial electronics receives data from the software providing device.

This downloader gender consists of a header to be connected to the software providing device and a pin header to be connected to electronics. The header and the pin header are connected via a substrate wherein the substrate provides compatibility between different terminals.

Since the downloader gender contains electrical connectors and an electric circuit, it is necessary to avoid contact with the outside such as contact with a human body. However, if this is simply put in a separate case and closed up, it can cause discomfort during use.

SUMMARY

It is an aspect of the present invention is to provide a downloader gender case that is easy to keep and use and is capable of protecting a substrate and connection terminals from contact with the outside.

The present invention is not limited to the above aspect and other aspects of the present invention will be clearly understood by those skilled in the art from the following description.

In order to solve the technical problems mentioned above, one aspect of the present invention provides a download gender case which can be coupled with a downloader gender consisting of a pin header to be coupled with one end of a substrate and a header to be coupled with the other end of the substrate, wherein the download gender case comprises: a fixed cover for fixing the substrate, configured to surround a part of the substrate and the periphery of the header and formed with a first through hole through which the header is opened; a slide cover disposed on the outer side of the fixed cover, configured to surround the other part of the substrate and the periphery of the pin header and formed with a second through hole through which the pin header is opened; and an opening and closing portion coupled with the slide cover to open and close the second through hole, the slide cover being capable of sliding in a direction toward the header or the pin header.

In one embodiment of the present invention, one end of the fixed cover is formed with a first engaging portion and one end of the slide cover is formed with a first hook portion, wherein the first engaging portion and the first hook portion are fastened together so that the slide cover can be fixed and the opening and closing portion can be closed.

In one embodiment of the present invention, the other end of the fixed cover is formed with a second engaging portion wherein the second engaging portion and the first hook portion are fastened together so that the slide cover can be fixed and the opening and closing portion can be opened to expose the pin header.

In one embodiment of the invention, an insertion portion is formed on a top portion of the substrate; the fixed cover comprises a first cover disposed above the part of the substrate and the header and provided with a fixing pin to be inserted into the insertion portion at a position corresponding to the insertion portion, and a second cover to be coupled with the first cover; and a second hook portion is formed on an inner bottom of the second cover to extend upward, so that the first cover and the second cover can be coupled with each other by the second hook portion.

In one embodiment of the invention, the first cover may be formed with a prominence and depression portion along a direction that the slide cover moves.

In one embodiment of the invention, protrusions may be formed on the inside or outside of the slide cover and the fixed cover may be provided with guide grooves of which grooves corresponding to the protrusions are formed to a predetermined length and stoppers for limiting sliding of the protrusions at one end of the guide grooves.

In one embodiment of the present invention, one end of the slide cover is formed with a third hook portion and a bottom of the second cover is formed with a third engaging portion, so that the third hook portion and the third engaging portion can be fastened together when the first engaging portion and the first hook portion are fastened together.

The present invention has advantageous effects that it is easy to keep and use a downloader gender and that a substrate and connection terminals can be protected from contact with the outside.

DETAILED DESCRIPTION

Figure 1:
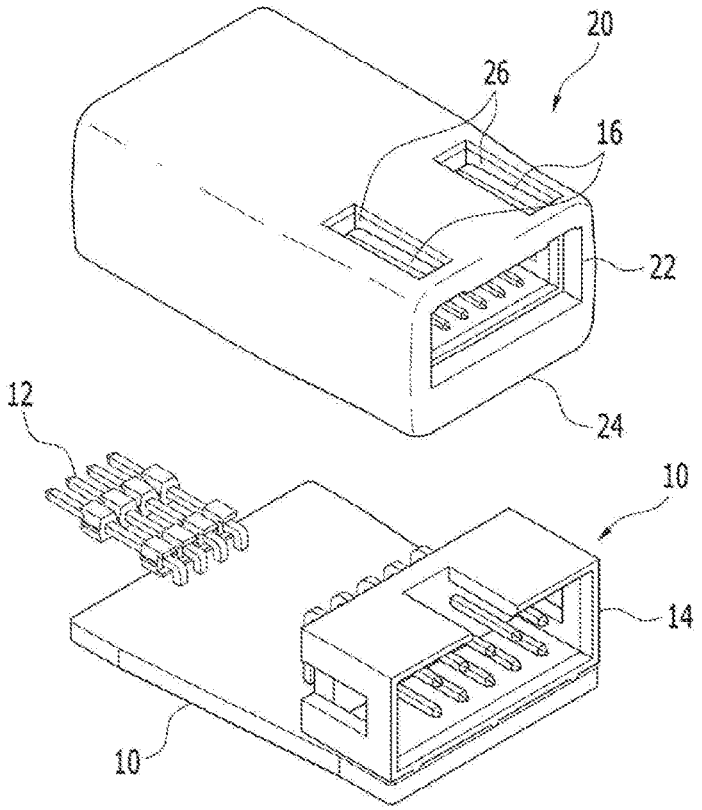
FIG. 1 is a configuration diagram illustrating a conventional downloader gender.

As the present invention may have different embodiments and various modifications thereto, specific embodiments are illustrated in the drawings and described in detail in the following description. This, however, is by no means to restrict the present invention to the specific embodiments, it is to be understood to include all changes, equivalents, and substitutes falling within the spirit and scope of the present invention.

Preferred embodiments of the present invention will now be described in detail with reference to the accompanying drawings.

FIG. 1 is a configuration diagram illustrating a conventional downloader gender.

A case 20 of a conventional downloader gender encloses and protects a downloader gender 10 consisting of a substrate 10, a pin header 12, and a header 14. In addition, the case 20 of the downloader gender comprises a lower cover 22, an upper cover 24 and through grooves 26.

The downloader gender 20 is seated within the downloader case 20 by inserting and engaging protrusions 16 formed on the top portion of the header 14 of the downloader gender 10 into the through grooves 26 of the lower cover 22. The upper cover 24 covers the lower cover 22 to protect the downloader gender 10 from contact with the outside.

However, this case 20 of the conventional downloader gender simply keeps the downloader gender 10. Therefore, although it may be easy to protect the downloader gender from contact with the outside during storage, the downloader gender must be separated from the case when using it. In this process, there is inconvenience that the user must directly handle the pin header 12, the substrate 10, and the header 14 with his/her hands and also a risk of damage thereto.

Further, since the pin header 12 is opened even during storage, foreign material is liable to touch it and external impact is also liable to exert thereto.

Hereinafter, an embodiment of the present invention will be described with reference to the drawings.

Figure 2:
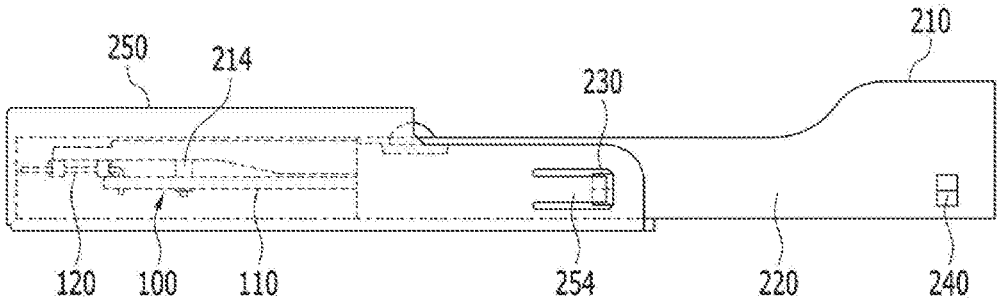
(PRIOR ART) FIG. 2
FIG. 2 is a right side view of a downloader gender case according to one embodiment of the present invention when a downloader gender is stored therein.
Figure 3:
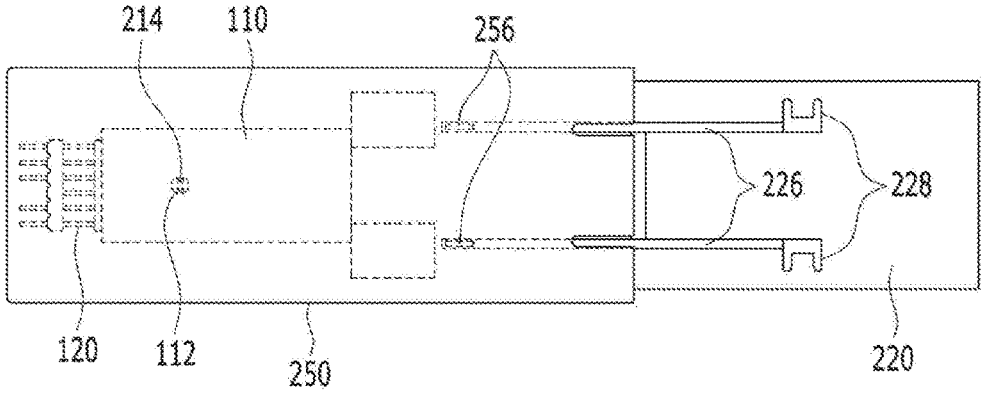
FIG. 3 is a bottom view of a downloader gender case according to one embodiment of the present invention when a downloader gender is stored therein.
Figure 4:
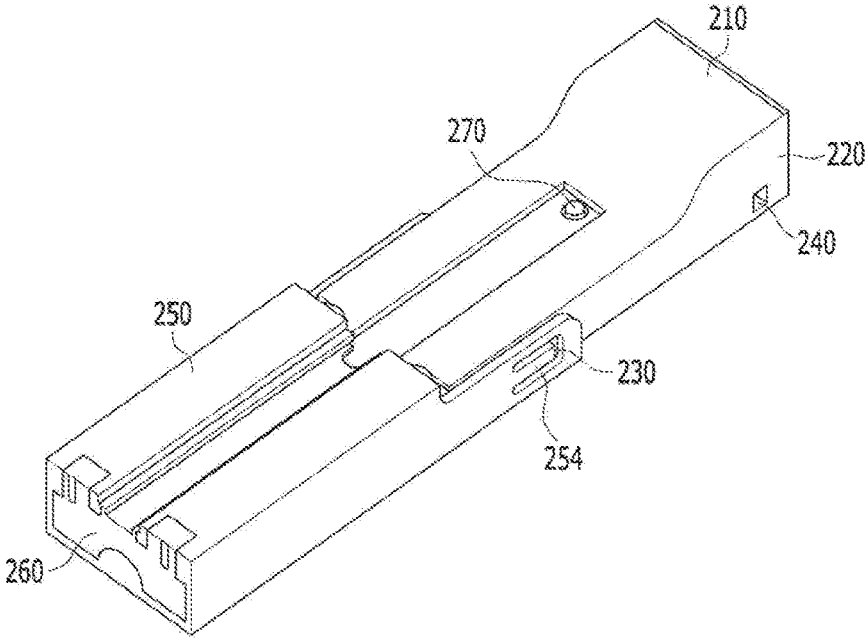
FIG. 4 is a perspective view of a downloader gender case according to one embodiment of the present invention when a downloader gender is stored therein.
Figure 5:
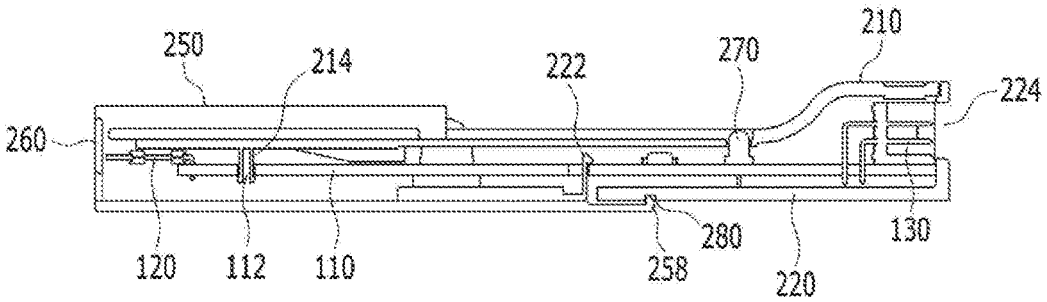
FIG. 5 is a cross-section view of a downloader gender case according to one embodiment of the present invention when a downloader gender is stored therein.

FIG. 2 is a right side view of a downloader gender case according to one embodiment of the present invention when a downloader gender is stored in the downloader gender case, FIG. 3 is a bottom view thereof, FIG. 4 is a perspective view thereof, and FIG. 5 is a cross-section view thereof, where this embodiment of the present invention is an example for using in a software downloader for industrial electronics.

Referring to FIGS. 2 to 5, detailed description will be made regarding the state that the downloader gender is stored in the downloader gender case according to one embodiment of the present invention.

As shown in the figures, the downloader gender case according to this embodiment of the present invention can be coupled with the downloader gender.

The downloader gender may comprise a substrate 110, a pin header 120 coupled to one end of the substrate 110, and a header 130 coupled to the other end of the substrate 110. The header 130 can be connected to a software providing device. In addition, the pin header 120 can be connected to industrial electronics to download software.

The substrate 110 may provide compatibility for data transfer through the header 130 and the pin header 120. The substrate 110 may comprise an LED 270 that can display connection between devices.

The pin header 120 may have a width narrower than that of the header 130. Width of about a half of the substrate 110 corresponds to the width of the pin header 120 while the rest of the substrate may be formed more narrowly than said width. The substrate 110 formed narrow and long and the pin header 120 coupled thereto can provide convenience in that it is possible to connect them to a connection terminal formed deeply with narrow width along an electronic device.

The downloader gender case comprises a fixed cover including a first cover 210 and a second cover 220, a first engaging portion 230, a second engaging portion 240, a slide cover 250, and an opening and closing portion 260.

The fixed cover allows the downloader gender to be seated and fixed therein. The first cover 210 is disposed above the substrate 110 and the pin header 120 and the header 130 to cover top portions thereof. However, pins of the pin header 120 may be left uncovered so that the pin header 120 can be connected to the electronic device with the pin header coupled to the first cover 210.

The first cover 210 may be formed to have a shape corresponding to that of the downloader gender. That is, the first cover 210 is formed narrower at a portion above the substrate 110 at the pin header 120 side than the other portion while it is formed wider at a portion above the header 130 side. The first cover above the header 130 includes an upward curved portion and may be formed high so as to secure a space in which the header 130 can be seated.

The first cover 210 may comprise a prominence and depression portion 212 and a fixing pin 214. The prominence and depression portion 212 is formed in a middle portion of the first cover above the substrate 110 to assist sliding action of the slide cover 250. The fixing pin 214 may be formed downward on the inner bottom of the first cover 210. In this case, the substrate 110 may be formed with an insertion portion 112 at a position corresponding to the fixing pin 214. The fixing pin 214 passes partially through the insertion portion 112 and is inserted through the substrate 110, and serves to secure the substrate 110 to the first cover 210.

The second cover 220 is disposed below a portion of the substrate 110 and the header 130 to cover bottom and side portions thereof.

The second cover 220 may comprise a second hook portion 222, a first through hole 224, guide grooves 226 and stoppers 228.

The second hook portion 222 may be extended upward from the inner bottom of the second cover 220. A barb or protrusion portion of the second hook portion 222 may be formed in a direction toward a position where the header 130 is seated so that it serves to push the substrate 110 in a direction toward the header 130 while the substrate is caught to the second hook portion 222.

The substrate 110 may comprise an engaging portion. When the engaging portion of the substrate 110 is located at a position of the second hook portion 222 and allows the second hook portion to be inserted therein, the substrate 110 is caught to the second hook portion 222 and pushed backward by elastic force of the second hook portion 222 and hence it is fixed. In addition, at the same time, the first cover 210 may be coupled with the second cover 220.

The first through hole 224 may be formed in a direction toward the header 130 so that a portion where the header 130 is disposed is opened. Terminal pins of a software providing device can be coupled with the open header 130.

The guide grooves 226 can guide sliding action of the slide cover 250 wherein the guide grooves 226 may be formed to extend to the stoppers 228. The stopper 228 can limit the distance that the slide cover 250 slides in a direction toward the header 130.

First engaging portions 230 may be formed on front opposite sides of the second cover 220. The first engaging portions 230 can assist to maintain the sliding cover 250 in a fastened state.

Second engaging portions 240 may be formed to be spaced with a predetermined distance from the first engaging portion 230 toward the header in a horizontal direction. The second engaging portions 240 can assist to maintain the slide cover 250 in a state that the slide cover has been slid to the maximum distance in a direction toward the header 130.

A third engaging portion 280 may be formed at a position spaced apart by a predetermined distance from an end of a bottom of the second cover 220. Here, the predetermined distance may correspond to a distance between the first engaging portion 230 and the second engaging portion 240.

The slide cover 250 may be formed to surround the other portion of the substrate 110 that are not enclosed by the fixed cover. Some of the slide cover 250 may be overlapped with the fixed cover. The lower lateral sides of the slide cover 250 can be extended longer than the upper lateral sides thereof in a direction toward the header 130.

The slide cover 250 comprises a second through hole 252, first hook portions 254, protrusions 256, and a third hook portion 258.

The second through hole 252 may be formed in a direction toward the pin header 120 so that the pin header 120 can be exposed. The pin header 120 exposed can be connected to an electronic device. First hook portions 254 may be formed on opposite sides of the slide cover 250. The first hook portions 254 may be formed on opposite inner sides of portions extended along opposite sides of the slide cover 250 respectively.

The first hook portions 254 can be fastened to any one of the first engaging portions 230 and the second engaging portions 240 so that it is possible to convert between a state of keeping the downloader gender in the downloader gender case and a state of using the downloader gender.

Protrusions 256 may be formed on the inside or outside of the slide cover 250. The slide cover 250 may be of a shape that a portion thereof surrounds the outside of the fixed cover, or otherwise a shape that a portion thereof is inserted into the inside of the fixed cover. In the former case, the protrusions 256 are formed on the inner bottom of the slide cover 250 while the guide grooves 226 are formed on the outer bottom of the second cover 220 such that they are engaged with each other. In the latter case, the protrusions 256 are formed on the outer bottom of the slide cover 250 while the guide grooves 226 are formed on the inner bottom of the second cover 220 such that they are engaged with each other. In the latter case, the first hook portions 254 of the slide cover 250 may also be formed on opposite outer sides of portions extended along opposite sides of the slide cover 250 respectively.

A third hook portion 258 may be formed at a bottom end of the slide cover 250. The slide cover 250 is fastened to the third engaging portion 280 via the third hook portion 258 so that a state of fixing the slide cover 250 to the second cover 220 becomes more firm.

The opening and closing portion 260 may be attached to the slide cover 250 at the top portion of the second through hole 252 of the slide cover 250. The opening and closing portion 260 may be attached via a hinge arranged on the top end of the slide cover 250.

The opening and closing portion 260 can cover the second through hole 252 and hence prevent the pin header 120 from being exposed to the outside in the storage state.

Figure 6:
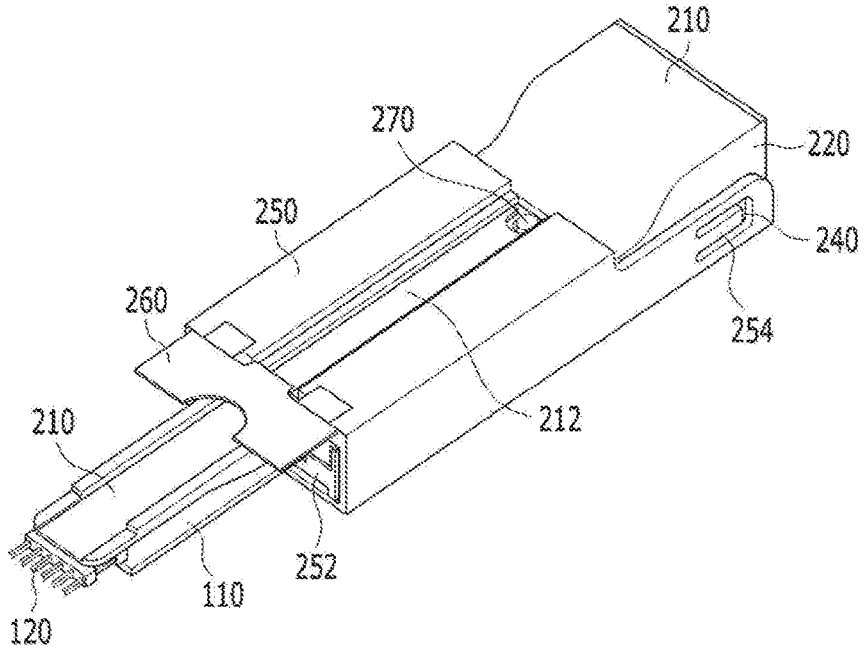
FIG. 6 is a perspective view of a downloader gender case according to one embodiment of the present invention when the downloader gender case is used.
Figure 7:
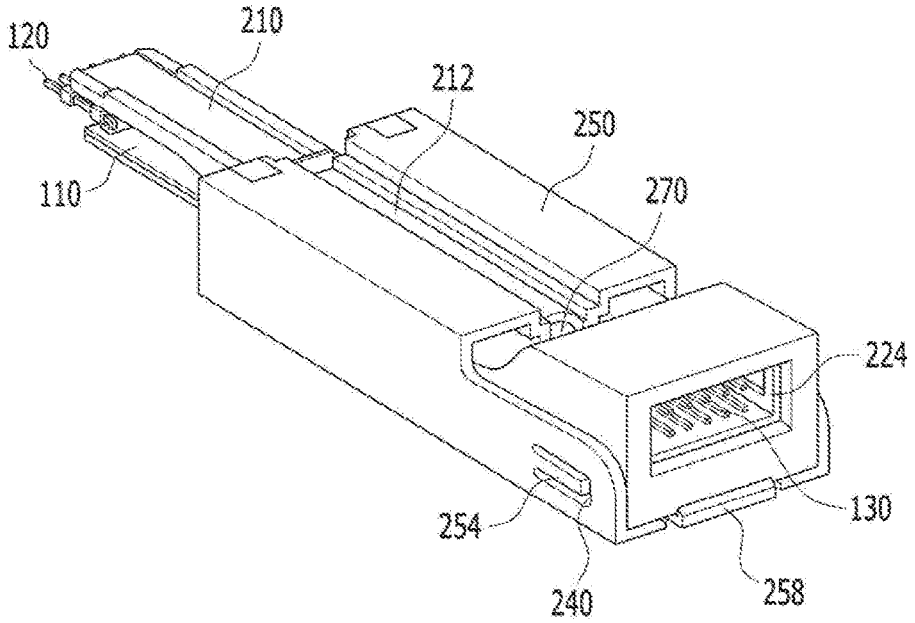
FIG. 7 is a perspective view from another direction of a downloader gender case according to one embodiment of the present invention when the downloader gender case is used.
Figure 8:
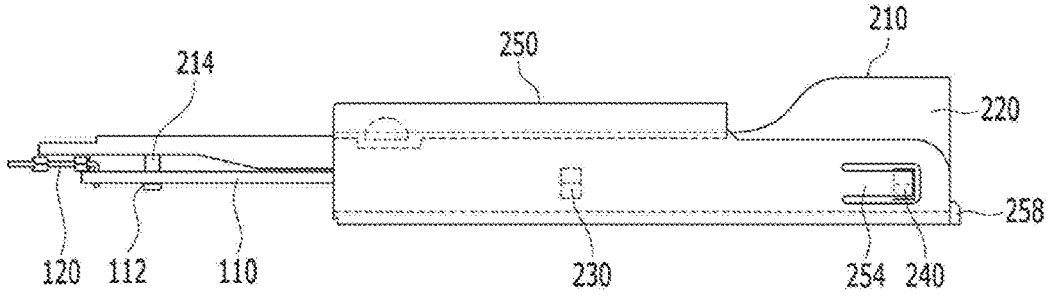
FIG. 8 is a right side view of a downloader gender case according to one embodiment of the present invention when the downloader gender case is used.
Figure 9:
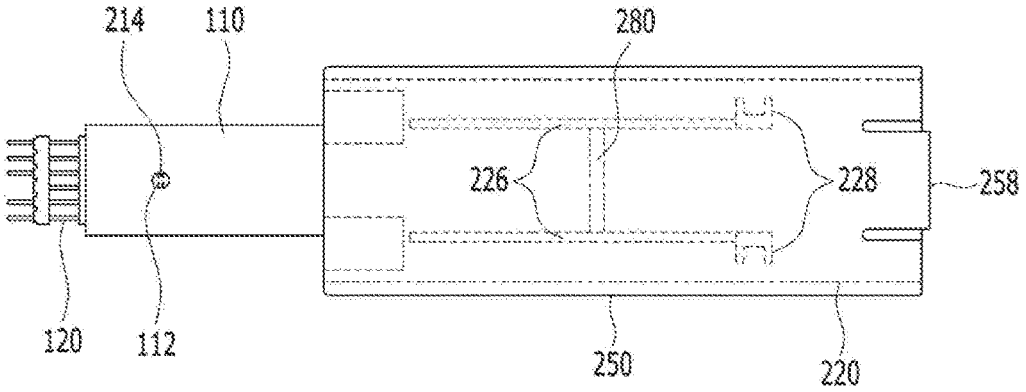
FIG. 9 is a bottom view of a downloader gender case according to one embodiment of the present invention when the downloader gender case is used.
Figure 10:
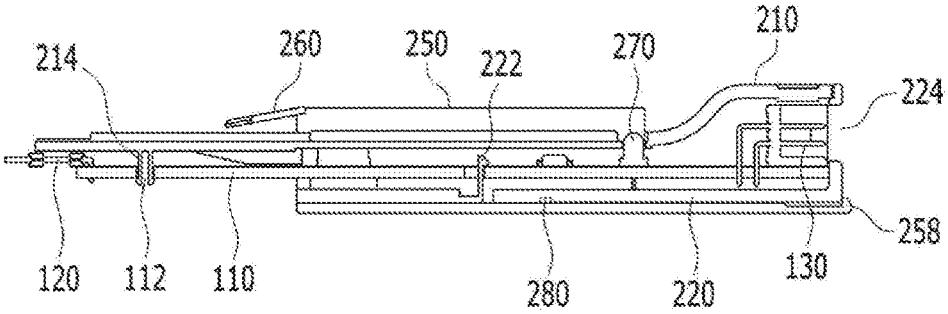
FIG. 10 is a cross-section view of a downloader gender case according to one embodiment of the present invention when the downloader gender case is used.

FIG. 6 is a perspective view of a downloader gender case according to one embodiment of the present invention when the downloader gender case is used, FIG. 7 is a perspective view from another direction thereof, FIG. 8 is a right side view thereof, and FIG. 9 is a bottom view thereof. In addition, FIG. 10 is a cross-section view thereof.

Referring to FIGS. 6 to 10, detailed description will be made regarding the state that the downloader gender case according to one embodiment of the present invention is used.

A user can fasten the first hook portion 254 to the first engaging portion 230 and release fastening between the third engaging portion 280 and the third hook portion 258 by applying external force to the slide cover 250 in the storage state. The slide cover 250 released from the fastened state can slide from that position to a predetermined distance in a direction toward the header 130. Here, the predetermined distance corresponds to a distance between the first engaging portion 230 and the second engaging portion 240.

When the user pushes the slide cover 250 up to the end in a direction toward the header 130, the first hook portion 254 of the slide cover 250 is fastened to the second engaging portion 240 and the third hook portion 258 is caught to the bottom end of the second cover 220.

Slide action is guided by the prominence and depression portion 212 of the first cover 210 and the guide grooves 226. However, stoppers 228 are formed at the end of the guide grooves 226 to block the protrusions 245 such that the slide cover 250 cannot move beyond a prescribed distance.

The pin header 120 of the downloader gender coupled to the fixed cover is confronted with the opening and closing portion 260 by sliding action. The opening and closing portion 260 is pushed outwardly by the pin header 120 and opened naturally. Even when slide action is completed and hence the downloader gender is in a using state, the second through hole 252 is kept open because the opening and closing portion 260 touches the first cover 210 arranged above the substrate 110 and hence cannot come down.

In a using state converted by the sliding action of the slide cover 250, the opening and closing portion 260 is opened and the pin header 120 is exposed. The substrate 110 connected with the pin header 120 is securely fixed through the fixing pin 214 of the first cover 210 and the second hook portion 222 of the second cover 220 and hence provides convenience when connecting the pin header 120 to electronics. Furthermore, as the fixing pin 214 is provided adjacent to the pin header 120 and the substrate 110 is fixed thereby, it is possible to reinforce resistance against bending which may be caused by a misaligned direction of force exerted to the electronics when connecting the pin header 120 to the electronics.

Once using of the downloader gender is completed, the user can slide the slide cover 250 in a reverse direction to convert back to a storage state that the downloader gender is received within the downloader gender case.

The present invention can prevent the downloader gender from being exposed to the outside in the storage state by means of the first cover 210, the second cover 220, and the opening and closing portion 260. Furthermore, as the pin header 120 can be exposed only when converting into a use state and then connected to electronics, the present invention has an effect of providing convenience of use as well as convenience of storage.

In the foregoing description, preferred embodiments according to the present invention are described, but they are merely exemplary examples of the invention. It is to be understood by those having ordinary skill in the art that various modifications and other embodiment equivalent to the invention can be made from the details discussed above. Therefore, the true scope of the present invention should be defined by the appended claims.

What is claimed is:

1. A download gender case, which is to be coupled with a downloader gender consisting of a pin header to be coupled with one end of a substrate and a header to be coupled with the other end of the substrate, comprising:

a fixed cover for fixing the substrate, configured to surround a part of the substrate and the periphery of the header and formed with a first through-hole through which the header is opened;

a slide cover disposed on the outer side of the fixed cover, configured to surround the other part of the substrate and the periphery of the pin header and formed with a second through-hole through which the pin header is opened; and an opening and closing portion coupled with the slide cover to open and close the second through-hole, the slide cover being capable of sliding in a direction toward the header or the pin header.

2. The download gender case of claim 1, wherein one end of the fixed cover is formed with a first engaging portion and one end of the slide cover is formed with a first hook portion and the first engaging portion and the first hook portion are fastened together so that the slide cover is fixed and the opening and closing portion is closed.

3. The download gender case of claim 2, wherein the other end of the fixed cover is formed with a second engaging portion and the second engaging portion and the first hook portion are fastened together so that the slide cover is fixed and the opening and closing portion is opened to expose the pin header.

4. The download gender case of claim 2, wherein an insertion portion is formed on a top portion of the substrate; the fixed cover comprises a first cover disposed above the part of the substrate and the header and provided with a fixing pin to be inserted into the insertion portion at a position corresponding to the insertion portion, and a second cover to be coupled with the first cover; and a second hook portion is formed on an inner bottom of the second cover to extend upward, so that the first cover and the second cover are coupled with each other by the second hook portion.

5. The download gender case of claim 4, wherein the first cover is formed with a prominence and depression portion along a direction that the slide cover moves.

6. The download gender case of claim 1, wherein protrusions are formed on the inside or outside of the slide cover and the fixed cover is provided with guide grooves of which grooves corresponding to the protrusions are formed to a predetermined length and stoppers for limiting sliding of the protrusions at one end of the guide grooves.

7. The download gender case of claim 4, wherein one end of the slide cover is formed with a third hook portion and a bottom of the second cover is formed with a third engaging portion, so that the third hook portion and the third engaging portion are fastened together when the first engaging portion and the first hook portion are fastened together.

* * * * *